US010143354B2

(12) United States Patent
Putnam, Jr.

(10) Patent No.: US 10,143,354 B2
(45) Date of Patent: Dec. 4, 2018

(54) DUCTED FOOTWEAR DRYER

(71) Applicant: Iron Lake LLC, Boulder, CO (US)

(72) Inventor: John E. Putnam, Jr., Boulder, CO (US)

( * ) Notice: Subject to any disclaimer, the term of this patent is extended or adjusted under 35 U.S.C. 154(b) by 0 days.

(21) Appl. No.: 15/600,238

(22) Filed: May 19, 2017

(65) Prior Publication Data

US 2018/0000313 A1 Jan. 4, 2018

Related U.S. Application Data

(60) Provisional application No. 62/338,848, filed on May 19, 2016.

(51) Int. Cl.
*A47L 23/20* (2006.01)
*F26B 9/00* (2006.01)

(52) U.S. Cl.
CPC ..... *A47L 23/205* (2013.01); *F26B 9/003* (2013.01)

(58) Field of Classification Search
CPC ..... A47L 23/205; F26B 9/003; F26B 9/04; A45D 20/08
USPC ..... 34/104
See application file for complete search history.

(56) References Cited

U.S. PATENT DOCUMENTS 3,417,482 A * 12/1968 Peet ..... A47L 23/20 219/523
5,289,642 A * 3/1994 Sloan ..... A43D 3/1491 34/104
5,720,108 A * 2/1998 Rice ..... A47L 23/205 34/104
5,729,908 A * 3/1998 Braden ..... A47L 23/205 34/104
5,819,433 A * 10/1998 Crooks ..... A43D 3/1491 34/104
5,894,680 A * 4/1999 Dalvy ..... A43B 7/28 34/104
5,930,913 A * 8/1999 Liao ..... A47L 23/205 34/104
6,216,359 B1 * 4/2001 Peet ..... A47L 23/205 34/105
6,606,801 B2 * 8/2003 Strang ..... A47L 23/205 34/104
6,713,971 B1 * 3/2004 Wong ..... F21V 19/0005 315/185 S
6,889,448 B1 * 5/2005 Frew ..... A47L 23/205 34/417
7,043,854 B2 * 5/2006 Peet ..... A47L 23/205 34/104
7,430,816 B1 * 10/2008 Lozenski ..... A47L 23/205 34/104
7,469,487 B2 * 12/2008 Macher ..... A47L 23/205 34/104

(Continued)

FOREIGN PATENT DOCUMENTS

KR 101505376 B1 * 3/2015

*Primary Examiner* — Stephen M Gravini
(74) *Attorney, Agent, or Firm* — Dorsey & Whitney LLP

(57) ABSTRACT

A footwear dryer is disclosed. The footwear dryer includes a ducted portion, a heating element positioned within the ducted portion that heats air passing over the heating element, a forced air generation device positioned within the ducted portion and oriented to force air through the ducted portion and over the heating element, and a power source configured to provide 12 volts or less and to power to the forced air generation device.

21 Claims, 4 Drawing Sheets

(56) References Cited

U.S. PATENT DOCUMENTS

| | | | | |
|---|---|---|---|---|
| 7,526,876 | B2 * | 5/2009 | Carey | A47L 23/205 34/103 |
| 8,186,075 | B2 * | 5/2012 | Beckett | A47L 23/205 34/106 |
| 8,898,929 | B2 * | 12/2014 | Stewart | D06F 59/04 134/103.2 |
| 8,955,234 | B2 * | 2/2015 | Williams | F26B 23/04 211/85.7 |
| 9,366,478 | B2 * | 6/2016 | DiMenichi | F26B 21/004 |
| 2010/0031526 | A1 * | 2/2010 | Tuckett | A47L 23/20 34/60 |
| 2011/0131827 | A1 * | 6/2011 | John | D06F 59/04 34/72 |
| 2012/0186096 | A1 * | 7/2012 | Fox | A47L 23/205 34/104 |
| 2018/0000313 | A1 * | 1/2018 | Putnam, Jr. | F26B 9/003 |

* cited by examiner

DUCTED FOOTWEAR DRYER

CROSS REFERENCE TO RELATED APPLICATIONS

The present disclosure claims priority to U.S. provisional application No. 62/338,848 entitled "Ducted Footwear Dryer," filed on May 19, 2016, which is hereby incorporated by reference herein in its entirety.

BACKGROUND

Many traditional footwear dryers use high voltages (e.g., 119V) to power their electrical components. Because traditional footwear dryers typically require such high voltage sources, the locations where they may be used is limited to those locations where high voltage power sources are available, such as traditional power outlets coupled to a power grid. Additionally, many traditional footwear dryers are floor mounted, meaning that the footwear dryer is connected to a stand or mount that sits on the ground, and the boot is inverted and placed on the footwear dryer. This limits portability as the footwear dryer must have a sufficiently large base to prevent the footwear dryer from becoming top heavy when a boot is placed on it.

SUMMARY

According to an embodiment, a footwear dryer is disclosed. The footwear dryer includes a ducted portion, a heating element positioned within the ducted portion that heats air passing over the heating element, a forced air generation device positioned within the ducted portion and oriented to force air through the ducted portion and over the heating element, and a power source configured to provide 12 volts or less and to power to the forced air generation device.

According to another embodiment, a footwear dryer is disclosed. The footwear dryer includes a first ducted section, a second ducted section coupled to the first ducted section at an angle, a heating element anchored to an interior portion of the first section, a forced air generation device anchored to the interior portion of the first section, and a power supply that provides power to the heating element and the forced air generation device, wherein the power supply provides a voltage of 12V or fewer.

According to another embodiment, a footwear dryer is disclosed. The footwear dryer includes a flow structure defining a flow pathway therethrough, a ceramic heater anchored to an interior surface of the ducted portion, a fan anchored to the interior surface of the ducted portion, a low voltage power supply coupled to the ceramic heater and the fan, and a coating on an exterior surface of the ducted portion.

OVERVIEW

Embodiments disclosed herein describe a portable, ducted footwear dryer for use with a universal serial bus (USB) power source. The footwear dryer may generally have a first section and a second section. In one embodiment, the second section may be oriented at approximately a 90° angle to the first section. In other embodiments, the second section may be oriented at a different angle (e.g., 60°) or no angle. The first and second sections may generally be hollow tubes or pipes. A heater and a forced air generation device may be positioned within the first section. The forced air generation device is configured to draw air through an open portion of the first section, and propel the air out of an open portion of the second section. As the air passes through the first section, the heater heats the air, which is then propelled out of the open portion of the second section. The heater and the fan may be powered by an external power source through, for example, a USB power cable. By using a USB power cable, the footwear dryer may take advantage of portability by allowing the footwear dryer to be used wherever a USB outlet is available, such as in an automobile. Selection of the type of heater and the forced air generation device is such that both may be operated based on a relatively low voltage power source, such as 5V provided by standard USB power sources.

DETAILED DESCRIPTION

Figure 1:
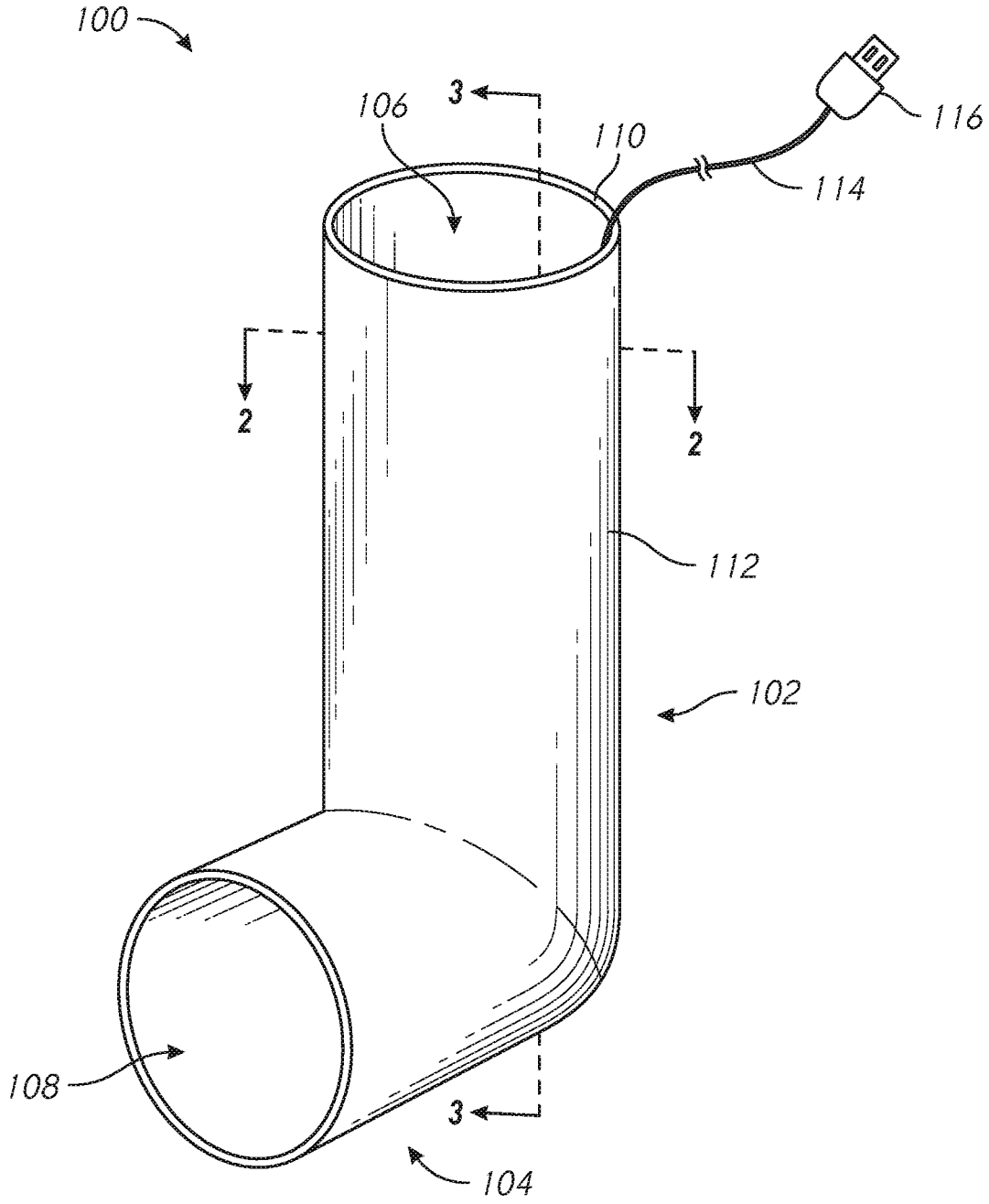
FIG. 1 is a perspective view of a portable, ducted footwear dryer.

FIG. 1 is a perspective view of a portable, ducted footwear dryer, generally designated 100. The footwear dryer 100 generally includes a first section 102 and a second section 104. The first section 102 has an open portion 106. The second section 104 has an open portion 108. The first section 102 and the second section 104 may include one or more pipe sections 110 and a coating 112. The pipe 110 creates a flow structure defining a flow pathway therethrough. The pipe sections 110 may be, for example, polyvinyl chloride (PVC) pipe. In other embodiments, other types of piping may be used, such as chlorinated polyvinyl chloride (CPVC) pipe, steel, aluminum, brass, wood, bamboo, etc. The pipe 110 may have a generally circular cross section to form a duct to guide forced air through the first and second sections. In other embodiments, the pipe 110 may have different cross-sectional shapes. In various embodiments, the first section 102 and the second section 104 may be a single, integrally formed pipe 110. In other embodiments, the first section 102 and the second section 104 may include two pipes 110 connected with a connection portion (not shown), such as an elbow joint. The first section 102 may be longer than the second section 104. By increasing the length of the first section 102, the first section 102 may aid to hold a portion of the footwear up, as in the case of long boots, to improve the drying process.

The pipe 110 may be partially or completely covered by the coating 112. In various embodiments, the coating 112 may be made of any suitable type of insulation such as rubber insulation, foam insulation, or other suitable material. In other embodiments, the coating 112 may include paint, tape, or other wraps, coatings, or materials. The coating 112 may improve the heat transfer properties of the footwear dryer 100 during operation to increase the amount of thermal energy output through the opening 108 of the second section 104 in the form of heated, forced air and to decrease the loss of thermal energy transferred through the pipe 110 of the first section 102 and the second section 104.

The footwear dryer further includes a power cable 114 coupled to a plug 116. The power cable 114 and plug 116 may provide power to a forced air generation device (see FIG. 2) and a heater (see FIG. 2). The forced air generation device and the heater are discussed in further detail below with respect to FIGS. 2 and 3. The power cable 114 and the plug 116 are configured to operate using a relatively low voltage power source (e.g., 12V or less). The power cable 114 may enable users to operate the footwear dryer 100 even when a standard 119V outlet is not available for use. For example, many automobiles are beginning to include USB ports for charging various electronic devices, such as mobile phones. By powering the footwear dryer 100 with a USB power source, the footwear dryer 100 may take advantage of new power sources that were previously unavailable for footwear dryers. In various embodiments, the power cable 114 and plug 116 may be USB standard compliant, for example, USB 1.0, 2.0, 3.0, 3.1, Type-B, Type-C, or micro-USB. However, footwear dryers have traditionally been unsuited to low voltage power sources because the electrical elements included in the footwear dryer require too high of voltage or current to be suitable for use with low voltage power sources. The power cable 114 and plug 116 may be configured to provide a predetermined voltage (e.g., +5V) and a particular current (e.g., up to 3 A) to provide power (e.g., 15W) to the forced air generation device and the heater. Traditional footwear dryers use high voltage power sources, such as standard 119 V outlets connected to a power grid, in order to provide sufficient power levels to activate the heater. By employing a low power consumption heater with a forced air, ducted design, embodiments herein are able to take advantage of the low voltage power supplies that are becoming increasingly available in automobiles, homes, laptop computers, etc., such as USB ports, allowing the dryer to be more portable, consume less energy, and be able to be used in more locations as compared to conventional footwear dryers.

Figure 2:
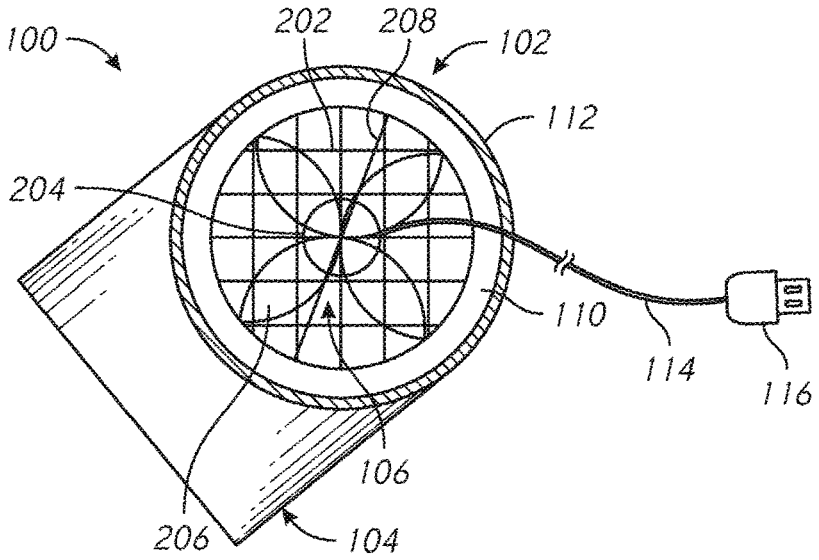
FIG. 2 is a cross-sectional view of the footwear dryer of FIG. 1 taken along the line 2-2.

FIG. 2 is a cross-sectional view of the footwear dryer 100 of FIG. 1 taken along the line 2-2. As shown in FIG. 2, the footwear dryer 100 may include a heater 202 and a fan 204. The fan 204 may have a plurality of blades 206. The fan may further include a number of anchors 208.

The fan 204 is one example of a forced air generation device, as discussed above with respect to FIG. 1. The fan may be positioned above or below the heater 202 in the first section 102. The fan 204 may be secured in place by the anchors 208 (e.g., screws, glue, nails, etc.), which fix the fan 204 to the interior of the pipe 110. The fan may be coupled to the power cable 114 and the plug 116. The power cable 114 provides power to the fan 204 to drive an electric motor configured to rotate the blades 206 to draw air in the open portion 106 of the first section 102, over the heater 202, and expel the air from the open portion 108 of the second section 104. The power cable 114 may be configured to be inserted in a groove formed in the outside of the pipe 110. The groove holds the power cable 114 in place and directs the power cable to the top of the footwear when the footwear dryer is inserted inside a boot or other item of footwear. The power cable 114 may be fixed in place, for example, with electrical tape and/or an adhesive prior to the application of the coating 112.

The blades 206 of the fan 204 may extend to an interior wall of the first section 102. In other words, the fan 204 may have a diameter that is selected to correspond to the diameter of the interior wall 102 in order to help retain the fan in place and ensure maximum air flow by maximizing the size of the blades. In operation, the heated air forced through the open portion 108 of the second section 104 may warm the interior of the boot and dry any moisture retained in the boot fabric. In various embodiments, the fan 204 may be a brushless thermal management fan. By using a brushless motor, the lifespan of the footwear dryer 100 may be increased. For example, in some embodiments, a brushless motor may have a lifespan of about 35,000 hours, whereas brushed fans may have a lifespan of only about 300 hours. The fan 204 may be configured to operate based on a 5V power supply and may be configured to draw up to 0.08 A of current. By containing the fan within the ducted portion of the pipe 110, increased airflow not available in traditional footwear dryers may be achieved. For example, the fan 204 may provide approximately 200 $ft.^3$/min of air.

As shown in FIG. 2, the heater 202 may be, for example, a wire mesh or netting heater. The heater 202 may be coupled to the power cable 114 and configured to receive power through the plug 116. The heater 202 may convert the electrical energy into thermal energy, for example, through resistive heating. The heater may extend across the diameter of the pipe 110. The heater 202 may define a number of openings to allow air to pass through the wire mesh/netting. Although shown as a wire mesh heater, a number of alternative heaters may be used. For example, the heater 202 may be a ceramic heater, a ring heater, a band heater, a silicone or polymide film heating pad, a tube heater, a coil heater, or any other suitable heater, so long as the heater is capable of being operated by a low voltage USB power source (e.g., 5V). In some embodiments, the heater 202 may be omitted.

Embodiments of the present disclosure recognize that there is a trade-off in powering the fan versus powering the heater. In various embodiments, the fan may be configured to operate at 5V and consume 0.1 A while the heater may be configured to operate at 5V and consume 0.9 A. Such a combination of voltage and current draw may be desirable because it enables a majority of the current to be provided to the heater to improve the efficiency of the drying process by increasing the temperature of the forced air.

Figure 3:
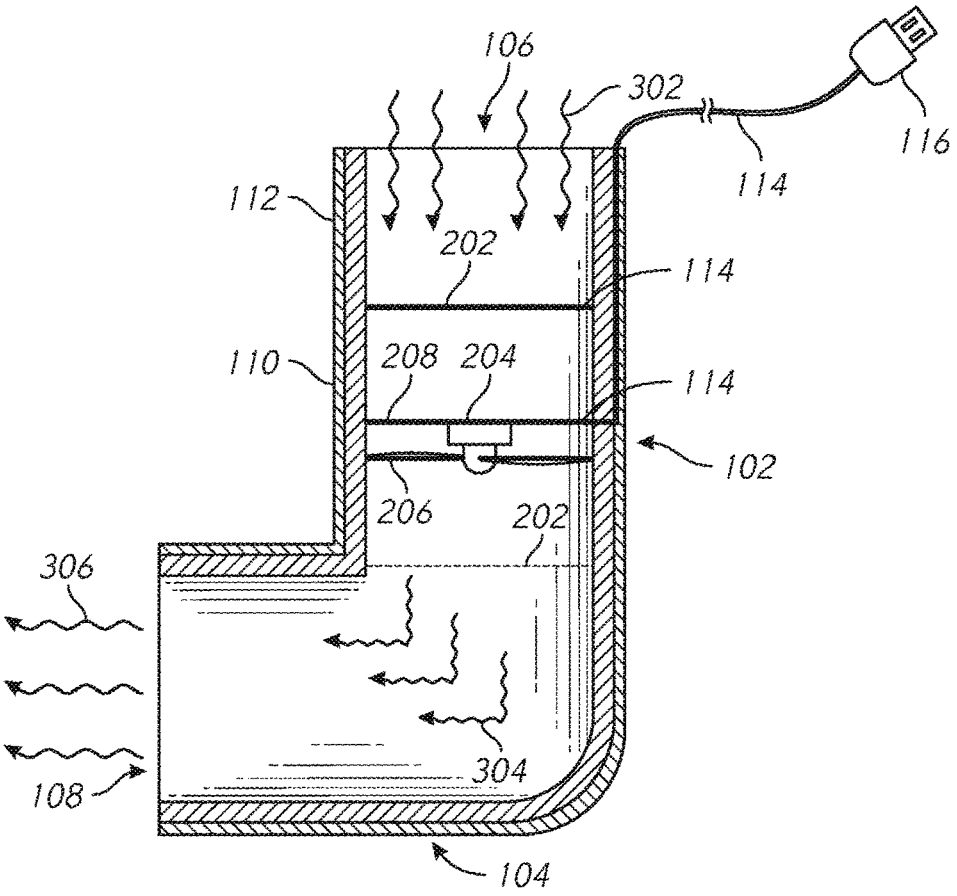
FIG. 3 is a cross-sectional view of the footwear dryer of FIG. 1 taken along the line 3-3.

FIG. 3 is a cross-sectional view of the footwear dryer of FIG. 1 taken along the line 3-3. As discussed above with respect to FIG. 2, FIG. 3 shows the heater 202 and the fan 204 positioned within the first section 102. During operation, the power cable 114 and plug 116 provide power to the heater 202 and the fan 204. The blades 206 of the fan rotate, creating a pressure differential within the footwear dryer 100. As a result of the pressure differential, cool air 302 is drawn into the first section 102 of the footwear dryer 100 through the open portion 106. As the air 302 passes through the first section 102, it passes over the heater 202, which is heated with power from the power cable 114 and the plug 116. The air 302 is heated as it passes over or through the heater 202 to create heated air 304. The fan 204 propels the heated air 304 through the remainder of the first section 102 and through the second section 104. The expelled air 306 exits the open portion 108 of the second section 104 and heats/dries the interior of the boot.

Figure 4:
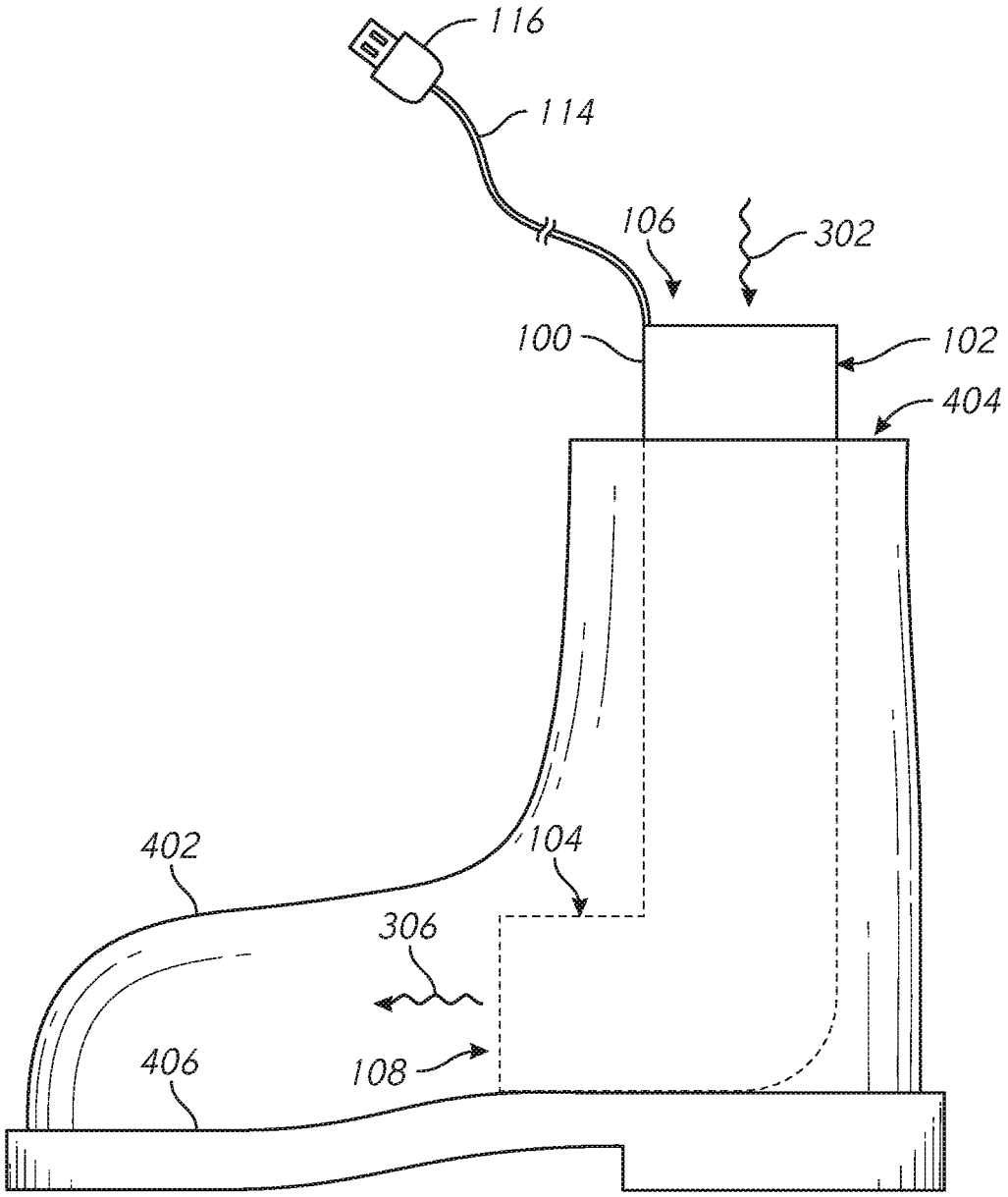
FIG. 4 is a cross-sectional view of a boot and the footwear dryer of FIG. 1.

FIG. 4 is a cross-sectional view of a boot 402 and the footwear dryer 100 of FIG. 1. The footwear dryer 100 may be placed within the foot opening 404 of the boot 402 such that the second section 104 is in contact with the interior sole 406 of the boot 402. Because the footwear dryer 100 is configured to operate with the footwear dryer 100 inserted substantially within the boot 402, eliminating the need for a bulky stand or support structure for the footwear dryer 100. The boot itself may provide the support for the footwear dryer 100. By containing the fan 204 within the first section 102, the footwear dryer 100 may be inserted entirely or nearly entirely within the boot 402. By containing the footwear dryer 100 substantially within the boot 402, portability may be increased by eliminating external fans or components that may be cumbersome or cause the boot to become top heavy, etc. and allows the boot 402 to be dried in any orientation or configuration. The boot 402 is not required to be upright or near the other boot to operate effectively. The plug 116 may be connected to a USB port, such as an automobile USB port, to provide electricity to the footwear dryer 100. The fan 204 may draw cool air 302 through the open portion 106, across the heater 202 (not shown in FIG. 4), and propel heated, expelled air 306 through the open portion 108 of the second section 104. Accordingly, the expelled air 306 may dry the interior of the boot 402 using a low voltage power source, such as a 5V USB power source.

Figure 5:
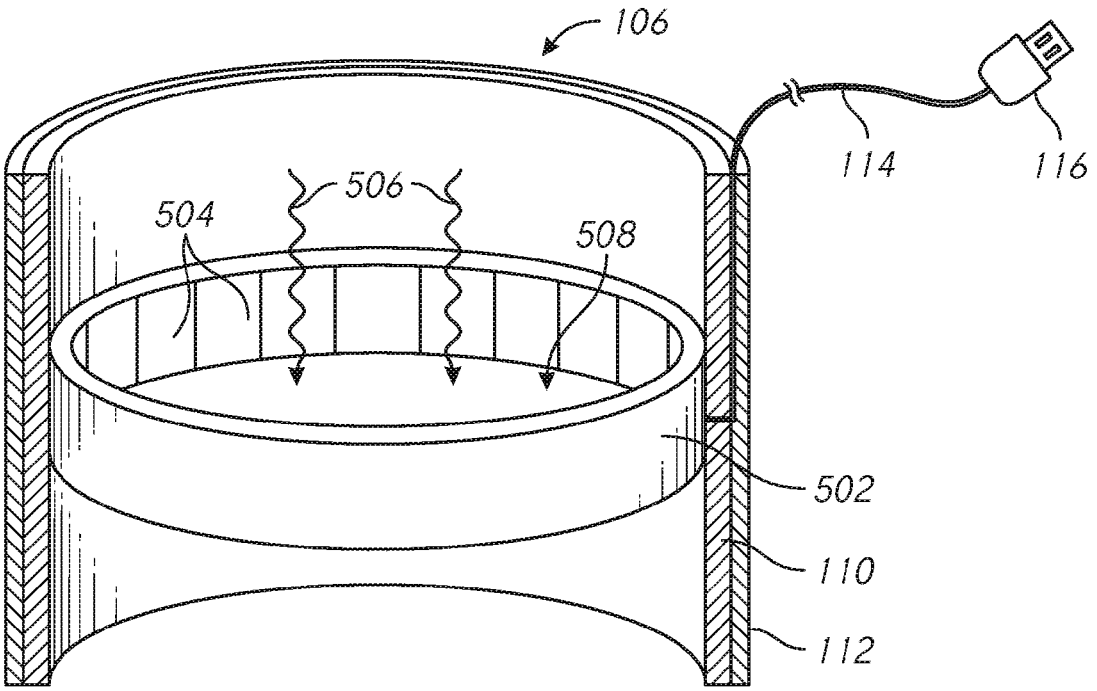
FIG. 5 is a partial cutaway view of a footwear dryer having a ceramic heater.

FIG. 5 is a partial cutaway view of a footwear dryer including a ceramic heater 502. The ceramic heater 502 may be placed within the first section 102 of the footwear dryer 100 and replace the heater 202. The ceramic heater 502 may include a number of ceramic elements 504 arranged in a cylindrical shape that generate heat when an electric current is applied to a coil in thermal contact with the ceramic elements 504. The electric current heats the coil and the heat is transferred to the ceramic elements 504 by conduction and/or induction. The ceramic elements 504 then radiate heat to the cooler air. The ceramic elements may be arranged in a ring shape to define a cavity 508. During operation, the fan may draw air 506 through the open portion 106 and through the cavity 506. In these embodiments, due to the ring shape of the heater, the open cavity 508 may be free from obstructions that would otherwise require a higher power fan or blower to compensate for the reduced flow area. As the air passes through the cavity 508, the air heats up due to the proximity to the ceramic elements 504. Power to the ceramic heater 502 may be supplied by the power cable 114 and the plug 116, which may be connected to a low voltage power supply, such as a USB port.

Figure 6:
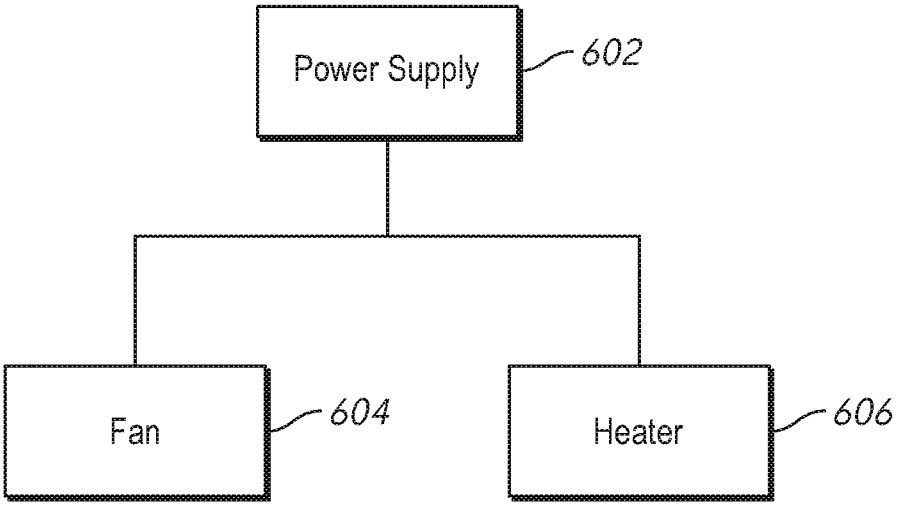
FIG. 6 is a functional block diagram of the footwear dryer of FIG. 1.

FIG. 6 is a functional block diagram of the footwear dryer 100 of FIG. 1. The footwear dryer 100 generally includes a low voltage power supply 602, a fan 604, and a heater 606. The low voltage power supply may generally be any type of supply configured to provide a low voltage (e.g., 12V or less). For example, the low voltage power supply 602 may be a USB port in an automobile. The fan 604 and the heater 606 may be implemented as described above with respect to the fan 204 and the heater 202, respectively. In various embodiments, the fan 604 and the heater 606 may be selected to operate in combination at no more than the voltage level supplied by the low voltage power supply 602.

What is claimed is:

1. A footwear dryer comprising:

a rigid duct defining a single fluid passageway therethrough and comprising a first ducted portion and a second ducted portion positioned at an angle relative to the first ducted portion, wherein the second ducted portion and at least a portion of the first ducted portion seat inside a piece of footwear when the footwear dryer is inserted in the piece of footwear;

a heating element positioned within and coupled to the duct that heats air passing over the heating element;

a forced air generation device positioned within the duct and oriented to draw fresh air from outside the piece of footwear into the duct and over the heating element, wherein all of the air pulled into the duct flows through the first and second ducted portions and is delivered into the piece of footwear; and a power cable that provides power from a power supply to the heating element and the forced air generation device, wherein the power supply provides a voltage of 12V or fewer.

2. The footwear dryer of claim 1, further comprising:

a coating encasing an exterior surface of the duct to hold the power cable against an outer surface of the duct, wherein the coating insulates the duct to reduce heat transfer to the exterior of the duct.

3. The footwear dryer of claim 2, wherein the duct comprises a groove formed in the exterior surface for receiving the power cable between the duct and the coating.

4. The footwear dryer of claim 1, wherein the heating element comprises one or more of a wire mesh heater, a ceramic heater, a ring heater, a band heater, a silicone or polymide film heating pad, a tube heater, or a coil heater.

5. The footwear dryer of claim 4, wherein the heating element comprises a ceramic heater and the ceramic heater comprises a plurality of ceramic heating elements arranged in a cylinder along an interior surface of the duct, such that air flowing through the duct flows over the plurality of heating elements.

6. The footwear dryer of claim 1, wherein the angle is between 60 degrees and 90 degrees.

7. A footwear dryer comprising:

a first rigid ducted section;

a second rigid ducted section extending from the first rigid ducted section at an angle, wherein the first rigid ducted section and the second rigid ducted section define a single flow pathway therethrough;

a heating element connected to an interior portion of the first rigid ducted section;

a forced air generation device connected to the interior portion of the first rigid ducted section, wherein the forced air generation device pulls fresh air from outside a single article of footwear into the first rigid ducted section, forces the fresh air through the second rigid ducted section, and delivers all of the fresh air through the flow pathway into the single article of footwear; and a power cable that provides power from a power supply to the heating element and the forced air generation device, wherein the power supply provides a voltage of 12V or less.

8. The footwear dryer of claim 7, wherein the heating element is anchored between the forced air generation device and a first open portion of the first rigid ducted section opposite of the second rigid ducted section.

9. The footwear dryer of claim 7, wherein the heating element is anchored between the forced air generation device and the second rigid ducted section.

10. The footwear dryer of claim 7, further comprising:

a coating surrounding an exterior portion of the first rigid ducted section and the second rigid ducted section.

11. The footwear dryer of claim 10, wherein at least a portion of the power cable is embedded between the coating and the exterior portion of the first rigid ducted section.

12. The footwear dryer of claim 7, wherein the second rigid ducted section is coupled to the first rigid ducted section at an angle of between 60 degrees and 90 degrees.

13. The footwear dryer of claim 7, wherein the heating element comprises one or more of a wire mesh heater, a ceramic heater, a ring heater, a band heater, a silicone or polymide film heating pad, a tube heater, or a coil heater.

14. A portable boot drying system comprising:

a rigid flow structure defining a single flow pathway therethrough, wherein the rigid flow structure has a first section and a second section positioned at an angle relative to the first section, wherein the single flow pathway directs air from outside a boot through the rigid flow structure such that all of the air flowing through the single flow pathway is delivered to an interior of the boot;

a ceramic heater anchored to an interior surface of the rigid flow structure;

a fan anchored to the interior surface of the rigid flow structure, wherein the fan pulls the air from outside the boot into the rigid flow structure;

a low voltage power supply coupled to the ceramic heater and the fan, wherein the low voltage power supply provides a voltage substantially equal to or less than 5 volts and a current maximum of 3 amps; and a coating on an exterior surface of the rigid flow structure.

15. The portable boot drying system of claim 14, wherein the coating comprises an insulator.

16. The portable boot drying system of claim 14, wherein the ceramic heater comprises a plurality of ceramic heating elements arranged in a cylinder along the interior surface of the rigid flow structure.

17. The portable boot drying system of claim 16, further comprising:

an electric coil in thermal contact with the plurality of ceramic heating elements, wherein the power supply provides an electric current to the electric coil to heat the plurality of ceramic heating elements.

18. The portable boot drying system of claim 14, wherein the fan comprises a brushless thermal management fan.

19. The footwear dryer of claim 7, wherein the first rigid ducted section at least partially supports at least a portion of the single article of footwear when positioned within the single article of footwear.

20. The footwear dryer of claim 1, wherein the power supply provides a voltage of 5V or fewer.

21. The footwear dryer of claim 1, wherein the first rigid ducted section and second rigid ducted section are integrally formed as a unitary member.

* * * * *